US005130753A

United States Patent [19]

Nakano et al.

[11] Patent Number: 5,130,753

[45] Date of Patent: Jul. 14, 1992

[54] ELECTROPHOTOGRAPHIC COPYING APPARATUS

[75] Inventors: Masaru Nakano, Tsukuba; Junichi Matsuno, Toride, both of Japan

[73] Assignees: Hitachi Ltd., Chiyoda; Hitachi Koko Ltd., Tokyo, both of Japan

[21] Appl. No.: 621,965

[22] Filed: Dec. 4, 1990

[30] Foreign Application Priority Data

Dec. 7, 1989 [JP] Japan ..... 1-318396

[51] Int. Cl.[5] ..... G03G 15/20

[52] U.S. Cl. ..... 355/282; 355/273

[58] Field of Search ..... 355/271, 273, 274, 275, 355/282, 289, 290

[56] References Cited

U.S. PATENT DOCUMENTS 4,369,729 1/1983 Shigenobu et al. ..... 355/271 X 4,407,580 10/1983 Hashimoto et al. ..... 355/275

FOREIGN PATENT DOCUMENTS 56-057069 5/1981 Japan .

0161157 7/1987 Japan ..... 355/271

*Primary Examiner*—A. T. Grimley

*Assistant Examiner*—P. Stanzione

*Attorney, Agent, or Firm*—Antonelli, Terry, Stout & Kraus

[57] ABSTRACT

A copy sheet, to which a developed image has been transferred by a transfer device, continues to be attracted to a copy sheet carrying surface of an insulating film and delivered toward a fusing roller pair. A force in a direction for pressing the copy sheet toward the insulating film is exerted, by an attraction strengthening device, on the copy sheet which is passing the vicinity of a downstream end of the copy sheet carrying surface after the transfer operation. This force strengthens a force for retaining the copy sheet on the copy sheet carrying surface of the insulating film, so as to hinder a portion of the copy sheet from being bent upwardly to the side of a photoreceptor and separated from the insulating film. Thus, separation of the copy sheet from the insulating film can be prevented from extending as far as a transfer position.

7 Claims, 5 Drawing Sheets

ELECTROPHOTOGRAPHIC COPYING APPARATUS

BACKGROUND OF THE INVENTION

The present invention relates to an electrophotographic copying apparatus and, more particularly, to an electrophotographic copying apparatus which prevent a misplacements of toner or transfer failures caused by the fact that a copy sheet attracted to and delivered on an insulating film is displaced from the insulating film when the copy sheet begins to be fed between fusing rollers.

Conventionally, when a leading end of a copy sheet abuts against fusing rollers, with a portion of the copy sheet which is electrostatically attracted to an insulating film being stationarily held, a force in a direction opposite to a direction of delivery of the copy sheet is exerted on a free portion of the copy sheet at the leading end side where it abuts against the fusing rollers so that the free portion is bent. When copy sheet has previously been deformed, the sheet can be bent by a slight force. When the copy sheet is bent, and when a component force of the above-mentioned force in a direction to cause the copy sheet to be separated from the insulating film becomes larger than a force of electrostatic attraction by the insulating film, separation of the copy sheet is further induced, thereby resulting in misplacements of toner of transfer failures.

In Japanese Patent Unexamined Publication No. 56-57069, an apparatus is proposed wherein means for mechanically holding a leading end of a copy sheet, such as claw clamping means, are provided in feeder means of an insulating film, to thereby prevent the copy sheet from being displaced due to the separation from the film during the transfer operation.

In the conventional apparatus disclosed in Japanese Patent Unexamined Publication No. 56-57069, the means for mechanically holding the leading end of the copy sheet are provided in the copy sheet feeder means of the insulating film, and, as a result, the apparatus is complicated and large in size.

SUMMARY OF THE INVENTION

The present invention has an object to solve problems of toner misplacements and transfer failures, while preventing a copy sheet from being displaced from without the interposition of an insulating film during the transfer operation mechanical means.

In order to attain this object, the present invention provides an electrophotographic copying apparatus comprising delivery means of an insulating endless film moving while defining at least one portion thereof as a flat copy sheet carrying surface, such that a copy sheet is electrostatically attracted to the copy sheet carrying surface and delivered in a direction tangent to a location where the copy sheet is kept in contact with the surface of a photoreceptor, and transfer means for transferring a developed image carried on the surface of the photoreceptor to a copy sheet. A pair of fusing rollers pair for fuse the developed image on the copy sheet by passing the copy sheet, to which the developed image has been transferred, between the rollers in contact with each other, with the fusing rollers being provided at the downstream side of the transfer means in a direction of delivery of the copy sheet. Attraction strengthening means apply a force in a direction for pressing the copy sheet at a downstream end of the copy sheet carrying surface toward the insulating film, which force is exerted on the copy sheet which has been passed through the transfer means.

Further, the present invention provides an electrophotographic copying apparatus comprising delivering means of an insulating endless film moving while defining at least one portion thereof as a flat copy sheet carrying surface, such that a copy sheet is electrostatically attracted to the copy sheet carrying surface and delivered in a direction tangent to a location where the copy sheet is kept in contact with the surface of a photoreceptor, and transfer means for transferring a development image carried on the surface of the photoreceptor to a copy sheet. A pair of fusing rollers fuse the developed image on the copy sheet by passing the copy sheet, to which the developed image has been transferred, between the rollers in contact with each other provided at the downstream side of the transfer means along the direction of delivery of the copy sheet. The contact portion of the pair of fusing rollers is located on the side of the photoreceptor with respect to an extension of a plane tangent to the location where the copy sheet carrying surface of the insulating film in contact with the photoreceptor. A distance between the contact portion of the pair of fusing rollers and an extension of the copy sheet carrying surface is at least 10 mm, and a plane passing through a pair of axes of rotation of the pair fusing roller is substantially perpendicular to the surface of the copy sheet fed between the fusing roller pair. The rotation axes are in parallel to a axis of rotation of the photoreceptor, and the peripheral speed of the pair of fusing rollers is lower than the delivery speed of the insulating film. A copy sheet feeder guide is provided between the pair of fusing rollers and the downstream end of the copy sheet carrying surface of the insulating film so as to guide the surface of the copy sheet which has been attracted to the insulating film. The copy sheet feeder guide is of a rectangular shape so that a longitudinal direction thereof is in parallel to axes of rotation of the pair of fusing rollers. The copy sheet feeder guide define an inclined surface which is away from the extension of the copy sheet carrying surface at a greater distance at a position closer to the pair of fusing rollers.

DESCRIPTION OF THE PREFERRED EMBODIMENTS

Figure 5:
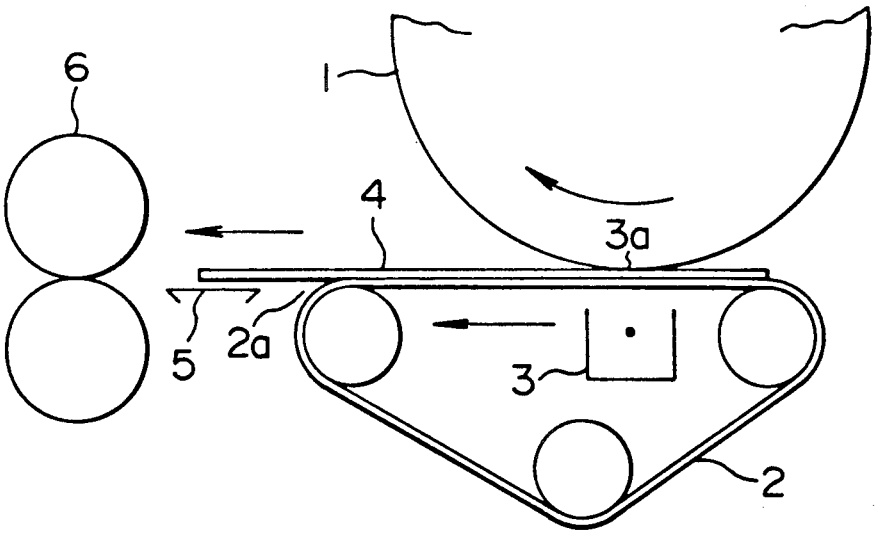
FIG. 5 (PRIOR ART)
FIGS. 5 and 6 are schematic side views illustrative of an example of a conventional apparatus.
Figure 6:
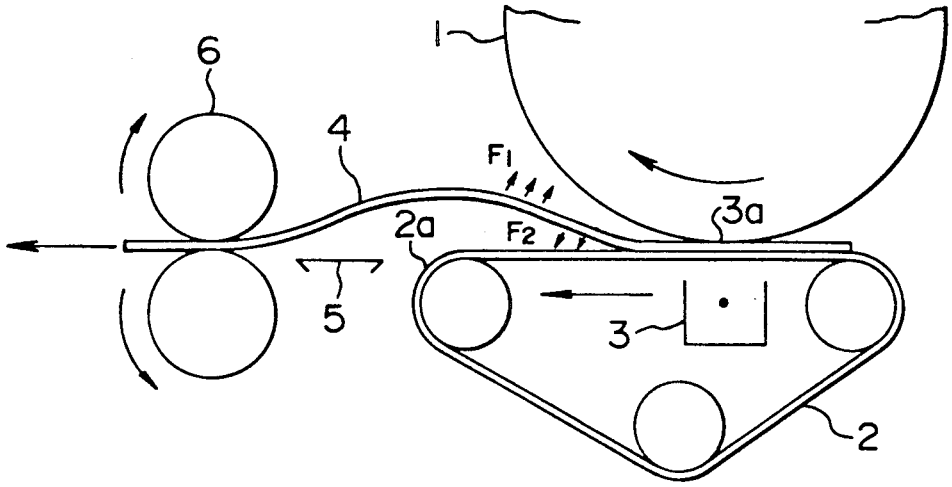
FIG. 6 (PRIOR ART)

In a conventional apparatus shown in FIGS. 5 and 6, a copy sheet 4, electrostatically attracted to an insulating film 2, is delivered by the insulating film 2, and, when the copy sheet 4 is subjected to a transfer corona discharge of a corrotron 3 from the back side of the insulating film 2 at a transfer position 3*a* underneath a photoreceptor 1, a developed image, carried on the surface of the photoreceptor, is transferred to the copy sheet 4. The transfer operation is effected without stopping the copy sheet 4, and after the transfer operation has been completed, the copy sheet 4 continues to be electrostatically attracted to the insulating film 2 and delivered. When the leading end of the delivered copy sheet 4 is separated from the insulating film 2 at a downstream end 2*a* of the insulating film, the leading end of the copy sheet 4 is further delivered along a copy sheet feeder guide 5, and the copy sheet 4 is fed between a pair of fusing rollers 6 rotating in a direction of delivery of the copy sheet 4. When the leading end of the copy sheet 4 abuts against the pair of fusing rollers 6, with a portion of the copy sheet 4 which is electrostatically attracted to the insulating film 2 being stationarily held, a reaction force, in a direction opposite to the delivery direction is exerted on a free end of the copy sheet 4 which is not electrostatically attracted to the insulating film 2, that is, the end which has collided with the fusing roller pair 6, so that this free end will be bent in a convex or concave condition. This bending of the copy sheet 4 is especially more pronounced when the copy sheet 4 has been previously subjected to a deformation such as, for example, a curl or curvature, whereby even a slight reaction force will bend the copy sheet 4.

Figure 7:
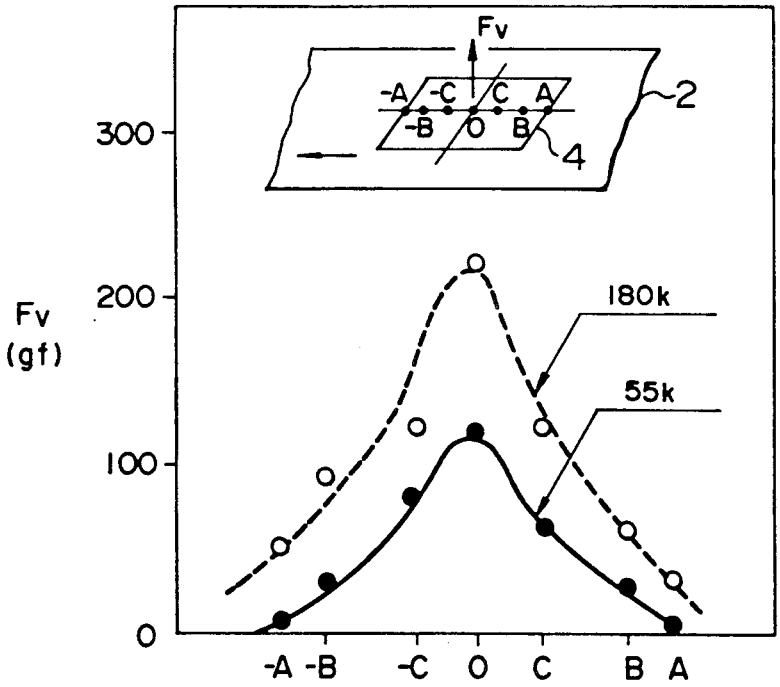
FIG. 7 is a graphical illustration of distributions of attraction force applied to copy sheets by an insulating film.

Referring to FIG. 6, if the free end of the copy sheet 4 which is, not electrostatically attracted to the insulating film 2 is, bent in a convex condition, the electrostatically attracted portion of the copy sheet 4 is affected by a force $F_1$ in a direction for separating the copy sheet 4 from the insulating film 2 in accordance with a deformation of the copy sheet 4. When the force $F_1$ becomes larger than a force $F_2$ of electrostatic attraction applied to the copy sheet 4, the separation area of the copy sheet 4 from the insulating film 2 is is progessively increased. More particularly, as shown in FIG. 7, with the abscissa representing measuring points on the electrostatically attracted copy sheet 4, a force Fv of electrostatic attraction applied to the copy sheet 4 by the insulating film 2 becomes smaller at measuring points closer to edges of the copy sheet 4, and this tendency is increases when the copy sheet is thinner. Therefore, once the copy sheet 4 starts to be separated from the insulating film 2, a small force gradually induces separation in a wider area, and, eventually, such a separation area extends as far as the transfer position 3*a*, thereby resulting in misplacements of toner or transfer failures. In the FIG. 7, reference characters 180*k* and 55*k* denote paper having a weight of 180 kg/1000 sheets and paper having a weight of 55 kg/1000 sheets, respectively.

Figure 1:
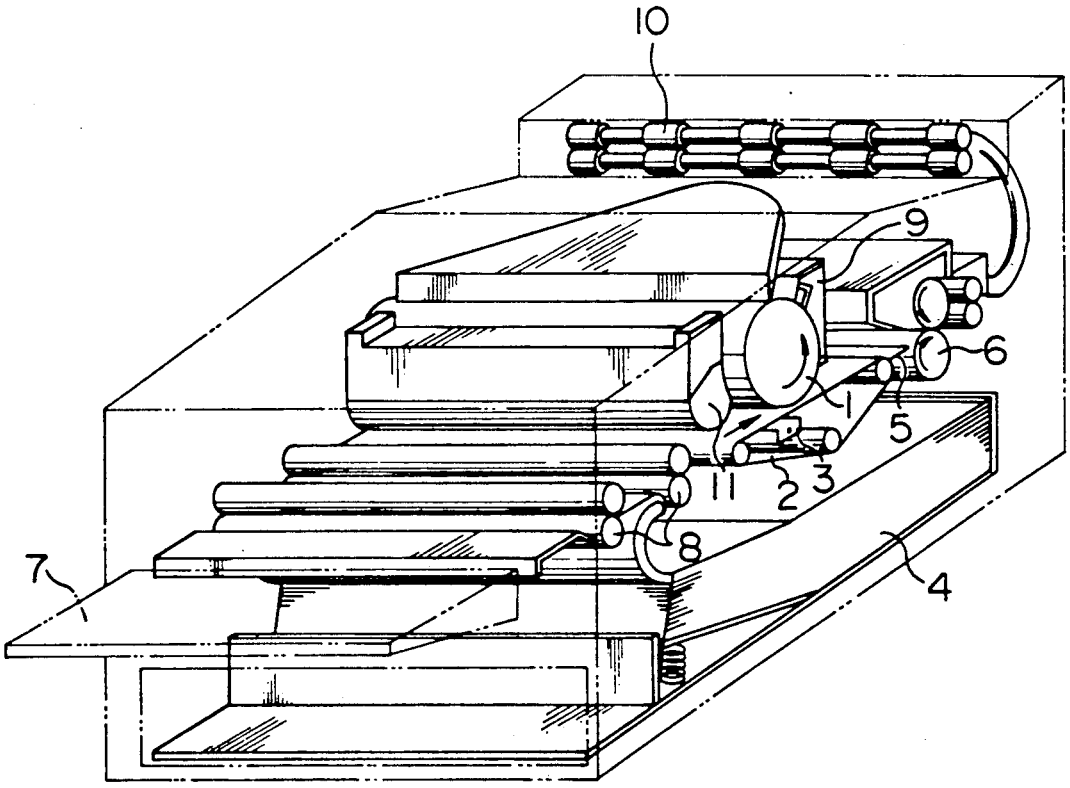
FIG. 1 is a perspective view showing one embodiment of the present invention.

FIG. 1 illustrates one embodiment of an electrophotographic copying apparatus according to the present invention. This drawing of the electrophotographic copying apparatus shows an essential portion of the structure concerning the present invention, with other portions manufactured according to known techniques such as a document handling/setting portion, a reading and processing portion of images on the document, and a toner supplying/cleaning portion being omitted. As shown in FIG. 1, copy sheets 4 of copy paper are stored in a bottom portion of the copying apparatus, with feeder rollers 8 delivering each copy sheet 4 insulating film 2, located at the downstream side of the feeder rollers 8, attracts the copy sheet 4 to the upper surface thereof to carry the copy sheet for. A photoreceptor 1 includes bottom portion adapted to be brought into contact with the copy sheet carrying surface of the insulating film 2 at a transfer position. A pair of fusing rollers 6 are located at the downstream side of the insulating film 2 along in a delivery direction of the copy sheet 4, with a copy sheet feeder guide 5 being interposed therebetween. Discharge rollers 10 are located at the downstream and upper side of the pair of fusing rollers 6, developer means 11 are located adjacent to the photoreceptor 1, with a cleaner 9 being located in contact with the outer peripheral surface of the photoreceptor 1 at a position downstream of the position where the photoreceptor 1 is in contact with the insulating film 2. A manual sheet feeder stand 7 is located at the upstream side of the feeder rollers 8.

In the electrophotographic copying apparatus of the above-described structure, the copy sheets 4 are introduced one by one from the storage into the feeder rollers 8 by introducing means not shown, and supplied onto the copy sheet carrying surface of the insulating film 2 which is driven by driving means 20. Each supplied copy sheet 4 is electrostatically attracted to the insulating film 2, delivered in a direction indicated by an arrow, and passed between the photoreceptor 1 and the insulating film 2 in contact with each other while tightly fitted between these two members. The developer means 11 causes a toner to be applied to the photoreceptor 1 so as to form a developed image. The image developed by the developer means 11 and attached on the surface of the photoreceptor 1 is brought into contact with the copy sheet 4, which is delivered by the insulating film 2, at the transfer position in response to rotation of the photoreceptor 1. The developed image in contact with the copy sheet is transferred to the copy sheet 4 by a corrotron 3 (see FIG. 2), whereas, the toner remaining on the surface of the photoreceptor 1 is removed by the cleaner 9. The copy sheet 4 to which the developed image is transferred is passed through the pair of fusing rollers 6 so as to perform the fusing operation, and subsequently, the copy sheet 4 is discharged to the outer surface of the copying apparatus by the discharge rollers 10. When the copy sheets 4 stored within the apparatus are not used, a required copy sheet is introduced along the manual sheet feeder stand 7 into the feeder rollers 8, and supplied onto the copy sheet carrying surface of the insulating film 2 by the feeder rollers 8.

Figure 2:
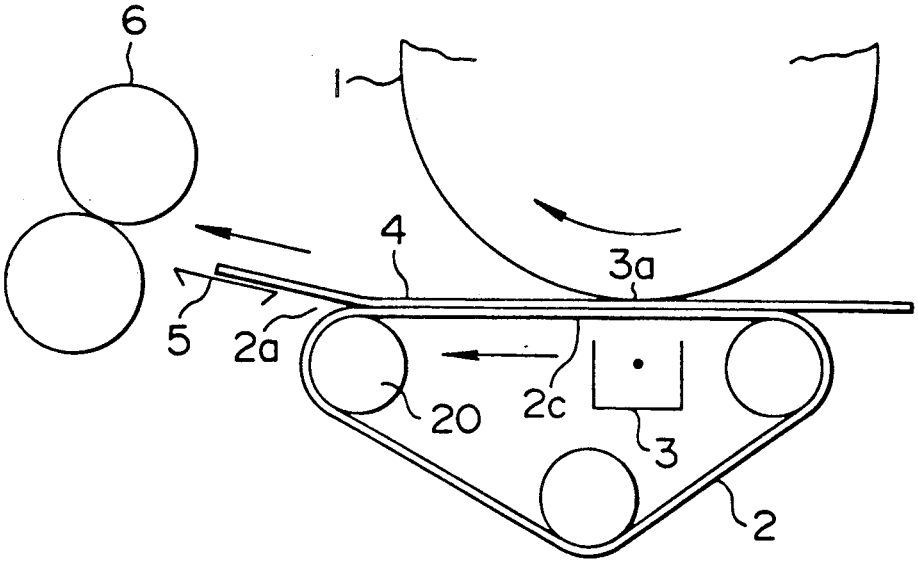
FIGS. 2 and 3 are partial schematic side views of the embodiment of FIG. 1.

As shown in FIG. 2, the photoreceptor 1 is a cylindrical rotary member, with the endless insulating film 2 being disposed around a plurality of rolls to have such a configuration as a substantially triangular shape, as viewed from the lateral side, with a side 2*c* being tangent to an outer peripheral bus line of the photoreceptor 1. An insulating film driving means 20 for rotates/drives the insulating film 2 at the same speed as the peripheral speed upon rotation of the photoreceptor 1, and the corrotron 3 is located opposite to the photoreceptor 1, with the insulating film 2 being interposed therebetween. At a transfer position 3*a* where the photoreceptor 1 is in contact with the insulating film 2, the rectangular feeder guide 5 for the copy sheet is located in the vicinity of the downstream end 2*a* of the side 2*c* of the insulating film 2 so that it will be brought into contact with the surface of the copy sheet 4 delivered on the insulating film 2, which surface has been attracted to the insulating film 2, in order to guide the copy sheet 4. The pair of fusing rollers 6 located at the downstream side of the feeder guide 5 for the copy sheet 4.

The feeder guide 5 for the copy sheet 4 is arranged at an angle to divert an advancing direction of the copy sheet 4 from a direction along the side 2c of the insulating film 2 toward the side of the photoreceptor receptor 1 (toward the side of the copy sheet where the developed image is transferred). Further, the pair of fusing rollers 6, each provided an axis of rotation in parallel to an axis of rotation of the photoreceptor 1, is located such that a plane passing through the axes of rotation of the pair of rollers 6 will be substantially perpendicular to an advancing direction of the copy sheet 4 which is being guided along the copy sheet feeder guide 5, and the location where the pair of rollers 6 are in contact with each other is 10 mm away from an extension line of the side 2c of the triangular shape toward the side of the photoreceptor 1.

The transfer device of the copying apparatus includes the photoreceptor 1, the insulating film 2, the insulating film driving means 20 and the corrotron 3.

In the copying apparatus of the above-described structure, as shown in FIG. 2, the copy sheet 4, electrostatically attracted to the insulating film 2, is delivered to the left in the drawing by the insulating film 2, and, when the copy sheet 4 is subjected to a transfer corona discharge of the corrotron 3 from the back side of the insulating film 2 at the transfer position 3a underneath the photoreceptor 1, a developed image, carried on the surface of the photoreceptor 1, is transferred to the copy sheet 4. The transfer operation is effected without stopping the copy sheet 4, and, after the transfer operation has been completed, the copy sheet 4 continues to be electrostatically attracted to the insulating film 2 and delivered along the side 2c of the triangular shape (the copy sheet carrying surface) of the insulating film 2. When the leading end of the delivered copy sheet 4 reaches the downstream end 2a of the side 2c, the leading end of the copy sheet 4 is separated from the downwardly advancing insulating film 2 due to rigidity of the copy sheet 4 for maintaining its flatness. The separated leading end of the copy sheet 4, with its surface which has been attracted to the insulating film 2 being guided along the feeder guide 5 for the copy sheet, is further delivered toward the pair of fusing rollers 6. The feeder guide 5 for the copy sheet, arranged at a certain angle with respect to the side 2c, serves to guide the leading end of the copy sheet 4 toward the left upper side of the drawing from a direction along an extension line of the side 2c, i.e., toward the side of the photoreceptor 1 with respect to the side 2c, to thereby feed the leading end into a contact portion of the pair of fusing rollers 6.

In general, the distance between the pair of fusing rollers 6 and the transfer position 3a is as short as possible in order to reduce the size of the copying apparatus, and it is less than the length of the copy sheet 4. When the leading end of the copy sheet 4 abuts against the pair of fusing rollers 6, with a portion of the copy sheet 4 which is electrostatically attracted to the insulating film 2 being stationarily held, a reaction force in a direction opposite to the delivery direction is exerted on a free end portion of the copy sheet 4 which is not electrostatically attracted to the insulating film 2 (a leading end portion). Since this free end portion is bent upwardly with respect to the portion of the copy sheet which is electrostatically attracted to the insulating film 2, this reaction force causes the free end portion of the copy sheet 4 to be pressed from the upper side toward the portion attracted to the insulating film 2, i.e., the copy sheet carrying surface of the side 2c. As a result, even if the copy sheet 4 previously has a deformation such as, for example, a curl, the reaction force serves to strengthen a force of electrostatic attraction between the insulating film 2 and the copy sheet 4. It can particularly prevent separation of the copy sheet 4 at the downstream end of the side 2c of the insulating film 2 from extending as far as the transfer position 3a.

Figure 3:
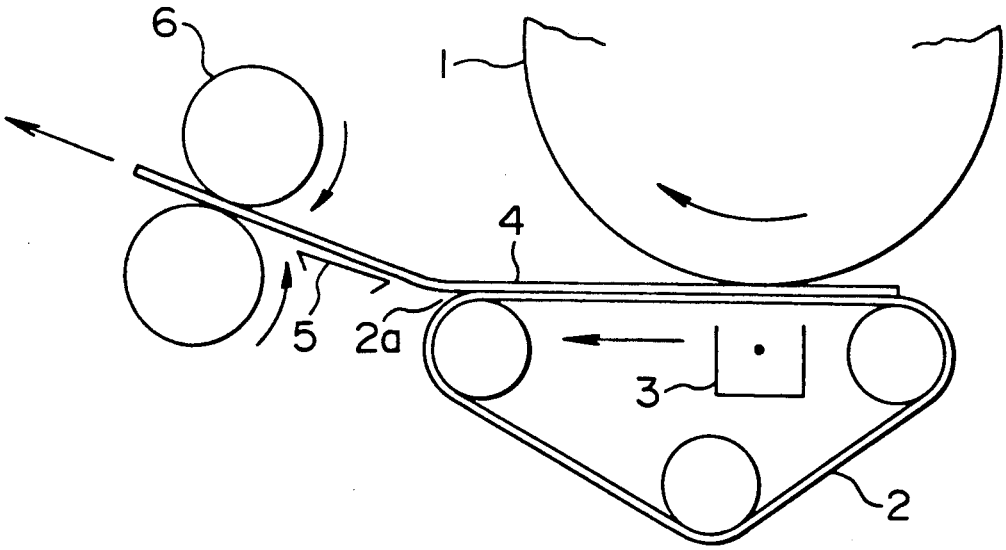
Figure 4:
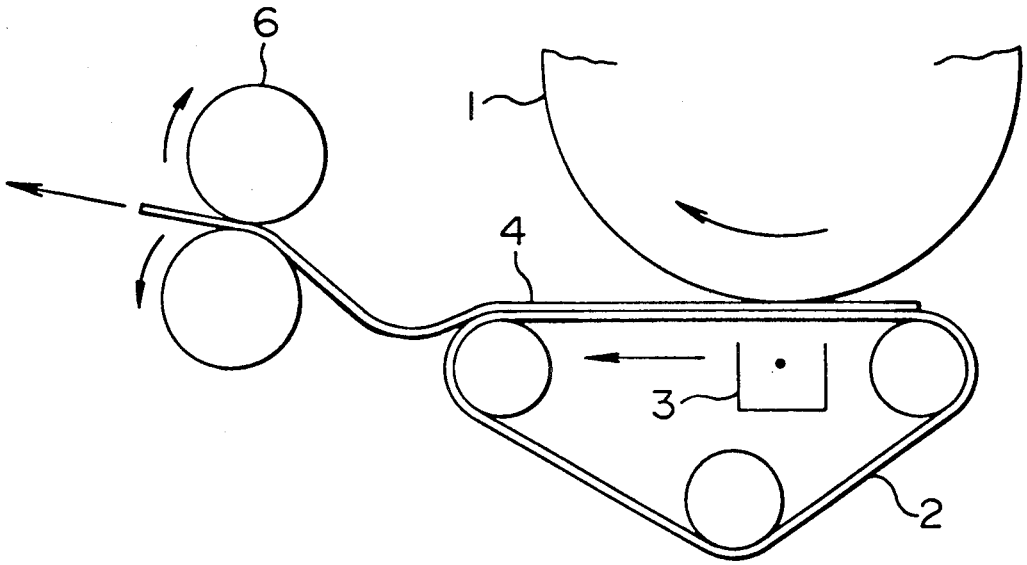
FIG. 4 is a schematic side view illustrative of a function in operation of the apparatus according to the present invention.

The same effect can be also obtained when the contact portion or nip portion of the pair of fusing rollers 6 (where the copy sheet 4 is passed) is provided on the side of the photoreceptor 1 with respect to the side 2c of the insulating film 2, and the peripheral speed of the pair of fusing rollers 6 is less than the copy sheet delivering speed of the insulating film 2. In this case, as shown in FIG. 3, when the copy sheet 4 is nipped into the contact portion of the fusing roller pair 6, the copy sheet 4 between the pair of fusing roller pair 6 and the downstream end 2a of the side 2c of the insulating film 2 is forcibly bent. Since the copy sheet 4 between the pair of fusing rollers 6 and the downstream end 2a of the side 2c is pressed from the upper side of the drawing toward the outer surface of the insulating film on the side 2c, i.e., the copy sheet carrying surface, it is always bent in a concave condition even if the copy sheet 4 previously has been deformed by for example, a curl. As illustrated in FIG. 4, therefore, when no copy sheet feeder guide is provided, the copy sheet 4 is fitted about the downstream end 2a of the side 2c of the insulating film 2 so as to prevent the copy sheet 4 at the downstream end portion of the side 2c of the insulating film 2 from being easily separated.

Figure 8:
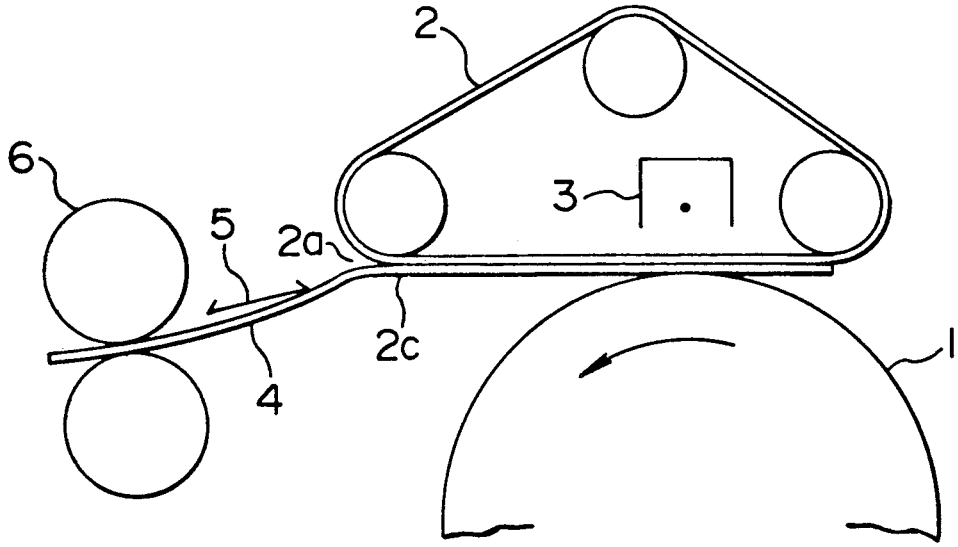
FIG. 8 is a partial schematic side view of another embodiment of the invention.

Referring to FIG. 8, when the corrotron 3 and the insulating film 2 are placed above the photoreceptor 1 in the contrary manner to FIG. 2, the contact portion of the pair of fusing rollers 6 may be provided below the copy sheet carrying surface (the side 2c), so as to obtain the same effect as shown in FIG. 2 where the corrotron 3 and the insulating film 2 are placed below the photoreceptor 1.

It has been experimentally determined that when the position of the contact portion of the pair of fusing rollers 6 is diverted from an extension plane of the side 2c of the insulating film 2 toward the side of the photoreceptor 1, with the distance between the contact portion and the extension plane being at least 10 mm, the copy sheet 4 is continuous 14 attracted to the insulating film as far as a circumferential portion of the downstream end 2a of the side 2c, as shown in FIG. 4.

According to this embodiment, the contact portion of the pair of fusing rollers 6, i.e., the nip portion of the same, is provided on the side of the photoreceptor 1 with respect to the outer surface or the copy sheet carrying surface of the insulating film 2, so that a reaction force will be exterted on the copy sheet 4 in order to press the copy sheet 4 toward the insulating film 2, and separation of the copy sheet 4 from the insulating film 2 can be consequently prevented from extending as far as the transfer position 3a, thereby preventing misplacements of toner or transfer failures.

Moreover, in the arrangement shown in FIG. 2 where the insulating film 2 is placed below the photoreceptor 1, it is more favorable to obtain an effect of the same kind that a distance l between the downstream end 2*a* of the side 2*c* of the insulating film 2 and the pair of fusing rollers 6 is larger, as easily understood from FIG. 9. In such a case, because the copy sheet 4 is bent downwardly, due to its own weight, in a concave condition between the downstream end 2*a* of the side 2*c* and the pair of fusing rollers pair 6, a force, is exerted, on the copy sheet 4 so that the copy sheet 4 can be prevented from being separated from the insulating fim 2 at the downstream end 2*a* of the side 2*c*. Especially when the peripheral speed of the pair of fusing rollers 6 is less than the copy sheet delivering speed of the insulating film 2, the copy sheet 4 is bent due to the speed difference and pressed against the vicinity of the downstream end 2*a* of the side 2*c* of the insulating film 2, so that the force is exerted on the copy sheet 4 for preventing the copy sheet 4 from being separated from the insulating film 2 in the same manner as the case where the contact portion of the pair of fusing rollers 6 is provided on the side of the photoreceptor 1 with respect to the copy sheet carrying surface of the insulating film 2, thus producing the same effect as the embodiment described previously.

Figure 9:
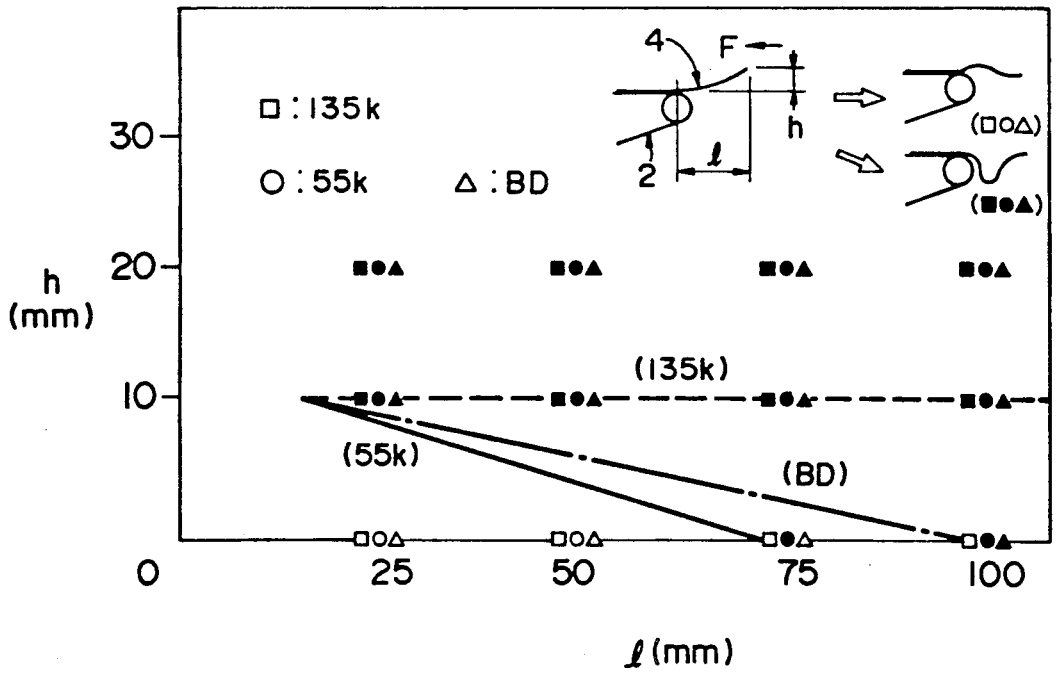
FIG. 9 is a graphical illustration of relationship between distances from a contact portion of a pair of fusing rollers to an extension of a copy sheet carrying surface and to a vertical plane perpendicular to a downstream end of an insulating film, as well as conditions of bending of copy sheets corresponding to these distances.

In FIG. 9, reference characters 55*k*, 135*k* and BD denote paper having a weight of 55 kg/1000 sheets, paper having a weight of 135 kg/1000 sheets and bond paper, respectively, and (55 kg), (135 kg) and (BD) indicate attractable ranges of the 55 kg/1000 paper, the 135 kg/1000 paper and the bond paper, respectively. Further, schematic drawings at the right upper side of the graph illustrate conditions of bending of the copy sheet, and reference marks ○, □, Δ represent convex bending conditions of the respective types of paper, while ●, ■, ▲ express concave bending conditions of the same.

According to the present invention, after a developed image has been transferred to the copy sheet while it is attracted to and delivered on the insulating film, the force in the direction for pressing the copy sheet against the insulating film is exerted on the copy sheet at the position where the copy sheet is to be released from the insulating film, and therefore, the copy sheet cannot be separated from the insulating film without difficulty. Thus, the copy sheet can be hindered from being easily displaced from the insulating film, preventing misplacements of toner or transfer failures.

What is claimed is:

1. An electrophotographic copying apparatus comprising:

delivery means for delivering an insulating endless film moving while defining at least one portion thereof as a flat copy sheet carrying surface, such that a copy sheet is electrostatically attracted to said copy sheet carrying surface and delivered in a direction tangential to a location where said copy sheet is maintained in contact with a surface of a photo receptor;

transfer means for transferring a developed image carried on the surface of said photoreceptor to said copy sheet;

a pair of contacting fusing rollers for fusing the developed image on said copy sheet by passing the copy sheet, to which the developed image has been transferred, between the pair of contacting fusing rollers provided at a downstream end of said transfer means, as viewed in a direction of delivery of said copy sheet; and attraction strengthening means for exerting, on said copy sheet which has been passed through said transfer means, a force in a direction for pressing said copy sheet at a downstream end of said copy sheet carrying surface toward said insulating film, said attraction strengthening means including are the pair of contacting fusing rollers whose contact portion is located on a side of said photo receptor with respect to an extension of a plane tangent to a location where said copy sheet carrying surface of the insulating film is in contact with the photo receptor.

2. An electrophotographic copying apparatus according to claim 1, wherein the distance between said contact portion of the fusing roller pair and said extension of the tangent plane is at least 10 mm.

3. An electrophotographic copying apparatus comprising:

delivery means for delivering an insulating endless film moving while defining at least one portion thereof as a flat copy sheet carrying surface, such that a copy sheet is electrostatically attracted to said copy sheet carrying surface and delivered in a direction tangential to a location where said copy sheet is maintained in contact with a surface of a photo receptor;

transfer means for transferring a developed image carried on the surface of said photoreceptor to said copy sheet;

a pair of contacting fusing rollers for fusing the developed image on said copy sheet by passing the copy sheet, to which the developed image has been transferred, between the pair of contacting fusing rollers provided at a downstream end of said transfer means, as viewed in a direction of delivery of said copy sheet; and attraction strengthening means for exerting, on said copy sheet which has been passed through said transfer means, a force in a direction for pressing said copy sheet at a downstream end of said copy sheet carrying surface toward said insulating film, said attraction strengthening means are the pair of contacting fusing rollers, and wherein a peripheral speed of contacting the pair of fusing rollers is less than a delivering speed of the insulating film.

4. An electrophotographic copying apparatus comprising:

delivery means for delivering an insulating endless film moving while defining at least one portion thereof as a flat copy sheet carrying surface, such that a copy sheet is electrostatically attracted to said copy sheet carrying surface and delivered in a direction tangential to a location where said copy sheet is maintained in contact with a surface of a photo receptor;

transfer means for transferring a developed image carried on the surface of said photoreceptor to said copy sheet;

a pair of contacting fusing rollers for fusing the developed image on said copy sheet by passing the copy sheet, to which the developed image has been transferred, between the pair of contacting fusing rollers provided at a downstream end of said transfer means, as viewed in a direction of delivery of said copy sheet; and attraction strengthening means for exerting, on said copy sheet which has been passed through said transfer means, a force in a direction for pressing said copy sheet at a downstream end of said copy sheet carrying surface toward said insulating film, said attraction strengthening means are the pair of contacting fusing rollers, said pair of contacting fusing rollers having a peripheral speed lower than a delivering speed of the insulating film, the contact portion of contacting said pair of fusing rollers being located on a side of said photoreceptor with respect to an extension of a plane tangent to a location where said copy sheet carrying surface of the insulating film is in contact with said photoreceptor.

5. An electrophotographic copying apparatus comprising:

delivery means for delivering an insulating endless film moving while defining at least one portion thereof as a flat copy sheet carrying surface, such that a copy sheet is electrostatically attracted to said copy sheet carrying surface and delivered in a direction tangential to a location where said copy sheet is maintained in contact with a surface of a photo receptor;

transfer means for transferring a developed image carried on the surface of said photoreceptor to said copy sheet;

a pair of contacting fusing rollers for fusing the developed image on said copy sheet by passing the copy sheet, to which the developed image has been transferred, between the pair of contacting fusing rollers provided at a downstream end of said transfer means, as viewed in a direction of delivery of said copy sheet; and attraction strengthening means for exerting, on said copy sheet which has been passed through said transfer means, a force in a direction for pressing said copy sheet at a downstream end of said copy sheet carrying surface toward said insulating film; and a copy sheet feeder guide between the pair of contacting fusing rollers and a downstream end of the copy sheet carrying surface of the insulating film so as to guide the surface of the copy sheet which has been attracted to the insulating film, said copy sheet feeder guide being of a rectangular shape so that a longitudinal direction thereof is in parallel to axes of rotation of the pair of contacting fusing rollers, said copy sheet feeder guide defining an inclined surface away from an extension of said copy sheet carrying surface at a greater distance at a position nearer to the pair of contacting fusing rollers.

6. An electrophotographic copying apparatus comprising:

delivery means for delivering an insulating endless film moving while defining at least one portion thereof as a flat copy sheet carrying surface, such that a copy sheet is electrostatically attracted to said copy sheet carrying surface and delivered in a direction tangential to a location where said copy sheet is maintained in contact with a surface of a photo receptor;

transfer means for transferring a developed image carried on the surface of said photoreceptor to said copy sheet;

a pair of contacting fusing rollers for fusing the developed image on said copy sheet by passing the copy sheet, to which the developed image has been transferred, between the pair of contacting fusing rollers provided at a downstream end of said transfer means, as viewed in a direction of delivery of said copy sheet; and attraction strengthening means for exerting, on said copy sheet which has been passed through said transfer means, a force in a direction for pressing said copy sheet at a downstream end of said copy sheet carrying surface toward said insulating film, wherein the plane passing through a pair of axes of rotation of the pair of contacting fusing rollers is substantially perpendicular to the surface of the copy sheet fed between the pair of contacting fusing rollers, said axes of rotation being in parallel to a axes of rotation of the photoreceptor.

7. An electrophotographic copying apparatus comprising:

delivery means for delivering an insulating endless film moving while defining at least one portion thereof as a flat copy sheet carrying surface, such that a copy sheet is electrostatically attracted to said copy sheet carrying surface and delivered in a direction tangential to a location where said copy sheet is maintained in contact with a surface of a photo receptor;

transfer means for transferring a developed image carried on the surface of said photoreceptor to said copy sheet;

a pair of contacting fusing rollers for fusing the developed image on said copy sheet by passing the copy sheet, to which the developed image has been transferred, between the pair of contacting fusing rollers provided at a downstream end of said transfer means, as viewed in a direction of delivery of said copy sheet; and attraction strengthening means for exerting, on said copy sheet which has been passed through said transfer means, a force in a direction for pressing said copy sheet at a downstream end of said copy sheet carrying surface toward said insulating film, wherein a plane passing through a pair of axes of rotation of the pair of contacting fusing rollers is substantially perpendicular to the surface of the copy sheet fed between the pair of contacting fusing rollers, said axes of rotation being in parallel to a axis of rotation of the photoreceptor, and a peripheral speed of the pair of contacting fusing rollers is less than the delivering speed of the insulating film.

* * * * *